US010443423B2

(12) United States Patent
McCaffrey

(10) Patent No.: US 10,443,423 B2
(45) Date of Patent: Oct. 15, 2019

(54) GAS TURBINE ENGINE BLADE OUTER AIR SEAL ASSEMBLY

(71) Applicant: Michael G. McCaffrey, Windsor, CT (US)

(72) Inventor: Michael G. McCaffrey, Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1149 days.

(21) Appl. No.: 14/834,918

(22) Filed: Aug. 25, 2015

(65) Prior Publication Data

US 2016/0084101 A1 Mar. 24, 2016

Related U.S. Application Data

(60) Provisional application No. 62/053,599, filed on Sep. 22, 2014.

(51) Int. Cl.

| | |
|---|---|
| ***F01D 11/08*** | (2006.01) |
| ***F01D 5/02*** | (2006.01) |
| ***F01D 5/12*** | (2006.01) |
| ***F01D 5/22*** | (2006.01) |
| ***F01D 11/12*** | (2006.01) |

(Continued)

(52) U.S. Cl.

CPC ..... *F01D 11/08* (2013.01); *F01D 5/02* (2013.01); *F01D 5/12* (2013.01); *F01D 5/225* (2013.01); *F01D 11/12* (2013.01); *F01D 11/14* (2013.01); *F01D 11/22* (2013.01); *F05D 2220/32* (2013.01); *F05D 2240/24* (2013.01); *F05D 2240/55* (2013.01); *F05D 2260/97* (2013.01)

(58) Field of Classification Search

CPC ..... F01D 11/08; F01D 11/12; F01D 11/14; F01D 11/22; F01D 5/02; F01D 5/12; F01D 5/225; F01D 11/122; F05D 2220/32; F05D 2240/24; F05D 2240/55; F05D 2260/97

USPC ..... 415/173.3, 139

See application file for complete search history.

(56) References Cited

U.S. PATENT DOCUMENTS

| | | | | |
|---|---|---|---|---|
| 4,247,248 A | | 1/1981 | Chaplin et al. | |
| 5,333,992 A | * | 8/1994 | Kane | F01D 11/005 415/138 |

(Continued)

FOREIGN PATENT DOCUMENTS

| | | | | |
|---|---|---|---|---|
| EP | 1270876 A2 | | 1/2003 | |
| EP | 2034132 A2 | * | 3/2009 | F01D 11/122 |

(Continued)

OTHER PUBLICATIONS

Extended European Search Report for European Application No. 15185719.0, dated Feb. 29, 2016.

*Primary Examiner* — Mark A Laurenzi
*Assistant Examiner* — Paul W Thiede
(74) *Attorney, Agent, or Firm* — Carlson, Gaskey & Olds, P.C.

(57) ABSTRACT

A gas turbine engine includes a rotating stage of blades. A circumferential array of blade outer air seal segments are arranged radially outward of the blades. Adjacent blade outer air seal segments provide a circumferential gap. Facing ends of the adjacent blade outer air seal segments include surfaces. A gap seal engages the surfaces and obstructs the circumferential gap. A biasing member is configured to urge the gap seal radially inward toward the surfaces.

19 Claims, 5 Drawing Sheets

(51) Int. Cl.
*F01D 11/14* (2006.01)
*F01D 11/22* (2006.01)

(56) References Cited

U.S. PATENT DOCUMENTS

| | | | | |
|---|---|---|---|---|
| 5,374,161 | A | 12/1994 | Kelch et al. | |
| 6,682,300 | B2 * | 1/2004 | Bolms | F01D 11/005 415/139 |
| 6,883,807 | B2 | 4/2005 | Smed | |
| 8,257,029 | B2 | 9/2012 | Habarou et al. | |
| 8,568,091 | B2 | 10/2013 | McCaffrey | |
| 2003/0202876 | A1 | 10/2003 | Jasklowski et al. | |
| 2005/0058540 | A1 | 3/2005 | Diakunchak | |
| 2009/0096174 | A1 | 4/2009 | Spangler et al. | |
| 2014/0023480 | A1 | 1/2014 | McCaffrey | |

FOREIGN PATENT DOCUMENTS

| | | | |
|---|---|---|---|
| EP | 2090754 | A2 | 8/2009 |
| EP | 2546469 | A2 | 1/2013 |

* cited by examiner

GAS TURBINE ENGINE BLADE OUTER AIR SEAL ASSEMBLY

CROSS REFERENCE TO RELATED APPLICATION

This application claims priority to U.S. Provisional Application No. 62/053,599 which was filed on Sep. 22, 2014.

BACKGROUND

This disclosure relates to a gas turbine engine blade outer air seal assembly. More particularly, the disclosure relates to a seal for a blade outer air seal assembly.

A gas turbine engine typically includes a fan section, a compressor section, a combustor section and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

A blade outer air seal assembly circumscribes an array of rotating blades in the turbine section. Typically, the blade outer air seal assembly is constructed from multiple arcuate blade outer air seal segments. Ends of adjacent segments are designed to seal relative to one another to prevent hot gases from the core flow path from penetrating the blade outer air seal assembly and undesirably increasing component temperatures.

Typically, the blade outer air seal assemblies are constructed from a high temperature, nickel-based superalloy, such as Mar-M-247. The ends are ship-lapped relative to one another to create a tortuous path that is more difficult for the hot gases to penetrate. The ends of the adjacent segments typically incorporate thin slots, where a thin, generally flat nickel-alloy seal is inserted to create a desirably sealed cavity to contain the cooling air, which is used to cool the segment, and prevent hot gases from the core flow path undesirably mixing with the cooling air. A thin, generally W-shaped nickel alloy seal is provided on a back face of the blade outer air seal segment joint to further obstruct the Z-shaped gap provided at the lap joint.

SUMMARY

In one exemplary embodiment, a gas turbine engine includes a rotating stage of blades. A circumferential array of blade outer air seal segments are arranged radially outward of the blades. Adjacent blade outer air seal segments provide a circumferential gap. Facing ends of the adjacent blade outer air seal segments include surfaces. A gap seal engages the surfaces and obstructs the circumferential gap. A biasing member is configured to urge the gap seal radially inward toward the surfaces.

In a further embodiment of the above, a turbine section is included with the rotating stage of blades arranged in the turbine section. The blades are turbine blades.

In a further embodiment of any of the above, an outer case is included. The blade outer air seal segments are supported relative to the outer case.

In a further embodiment of any of the above, each end includes a groove that adjoins the tapered surface and comprising a mount block that cooperates with facing grooves to support the adjacent blade outer air seals to the outer case.

In a further embodiment of any of the above, a fastener assembly secures the mount block to the outer case.

In a further embodiment of any of the above, a mount block is integral to the outer case.

In a further embodiment of any of the above, the biasing member is arranged radially between the fastening assembly and the gap seal. The surfaces are tapered surfaces that form an obtuse angle with one another.

In a further embodiment of any of the above, a shim is arranged in the groove between and engages the end and the mount block.

In a further embodiment of any of the above, the shim is discrete from the biasing member.

In a further embodiment of any of the above, the gap seal has a wedge-shaped cross-section in a circumferential direction.

In a further embodiment of any of the above, the gap seal has a double wedge-shaped cross-section in a circumferential direction.

In a further embodiment of any of the above, the gap seal has sloped surfaces that join one another at an apex that extends in an axial direction. The apex is arranged at the gap.

In a further embodiment of any of the above, a radial biasing member acts on the gap seal to adjust the gap seals orientation to maintain contact with the tapered surfaces.

In a further embodiment of any of the above, each end includes an edge that extends in a radial direction. The edges adjoin the respective tapered surface. Facing edges are generally parallel to one another.

In a further embodiment of any of the above, the blade outer air seal segments and the gap seal have coefficients of thermal expansion that are generally between 2.5 ppm/° C. and 4.5 ppm/° C.

In a further embodiment of any of the above, the blade outer air seal segments are a ceramic-based material.

In a further embodiment of any of the above, the gap seal is a ceramic-based material.

In another exemplary embodiment, a gap seal for a gas turbine engine blade outer air seal array includes a body that has sloped surfaces that join at an apex that is arranged opposite a rectangular face. The body is a ceramic-based material.

In a further embodiment of the above, the apex extends in a longitudinal direction of the body.

In a further embodiment of any of the above, the sloped surfaces are at an obtuse angle relative to one another.

In a further embodiment of any of the above, the sloped surfaces are planar.

In a further embodiment of any of the above, the body has a double wedge-shaped cross-section in a circumferential direction.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
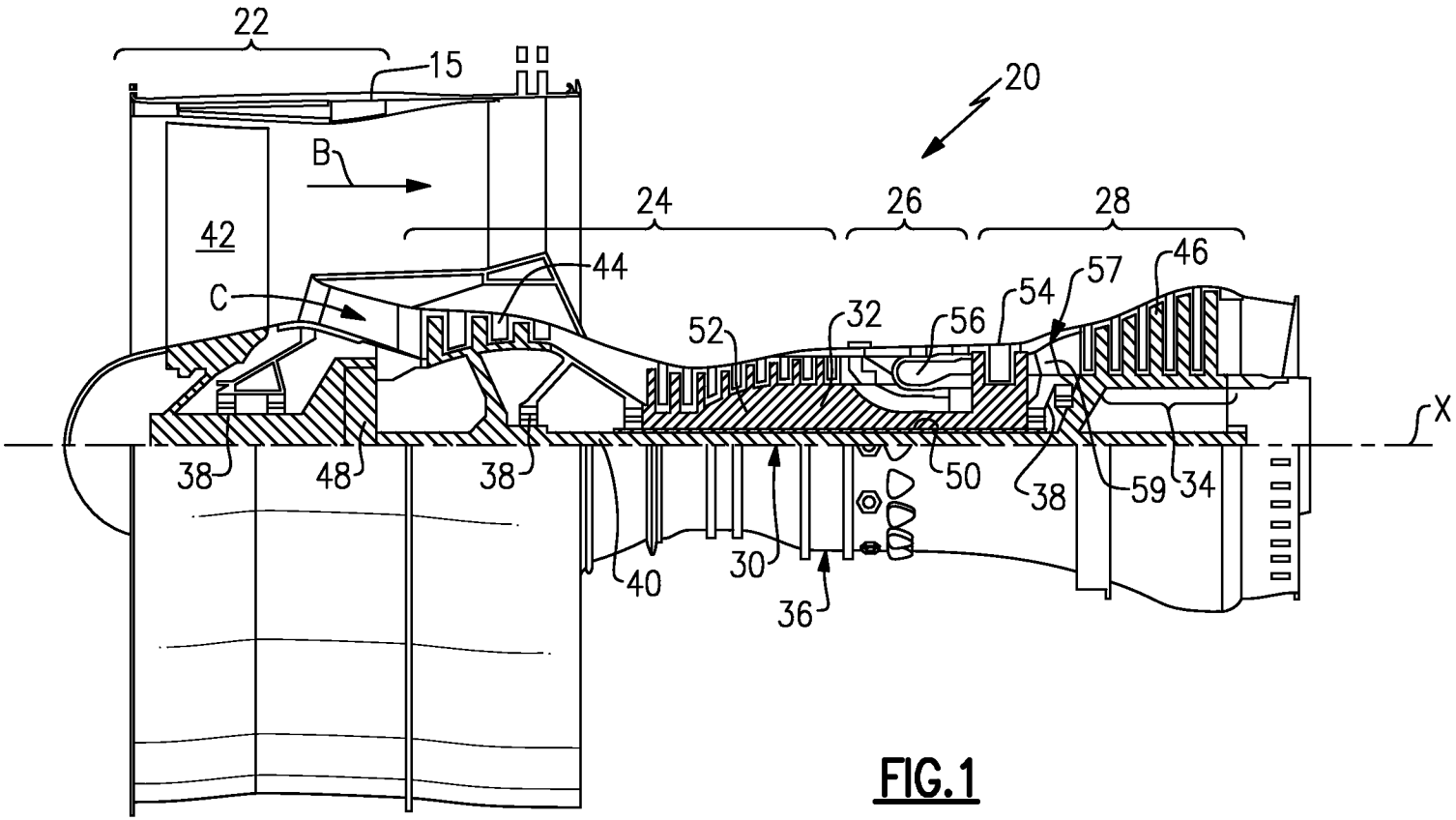
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis X relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis X which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 meters/second).

Figure 2:
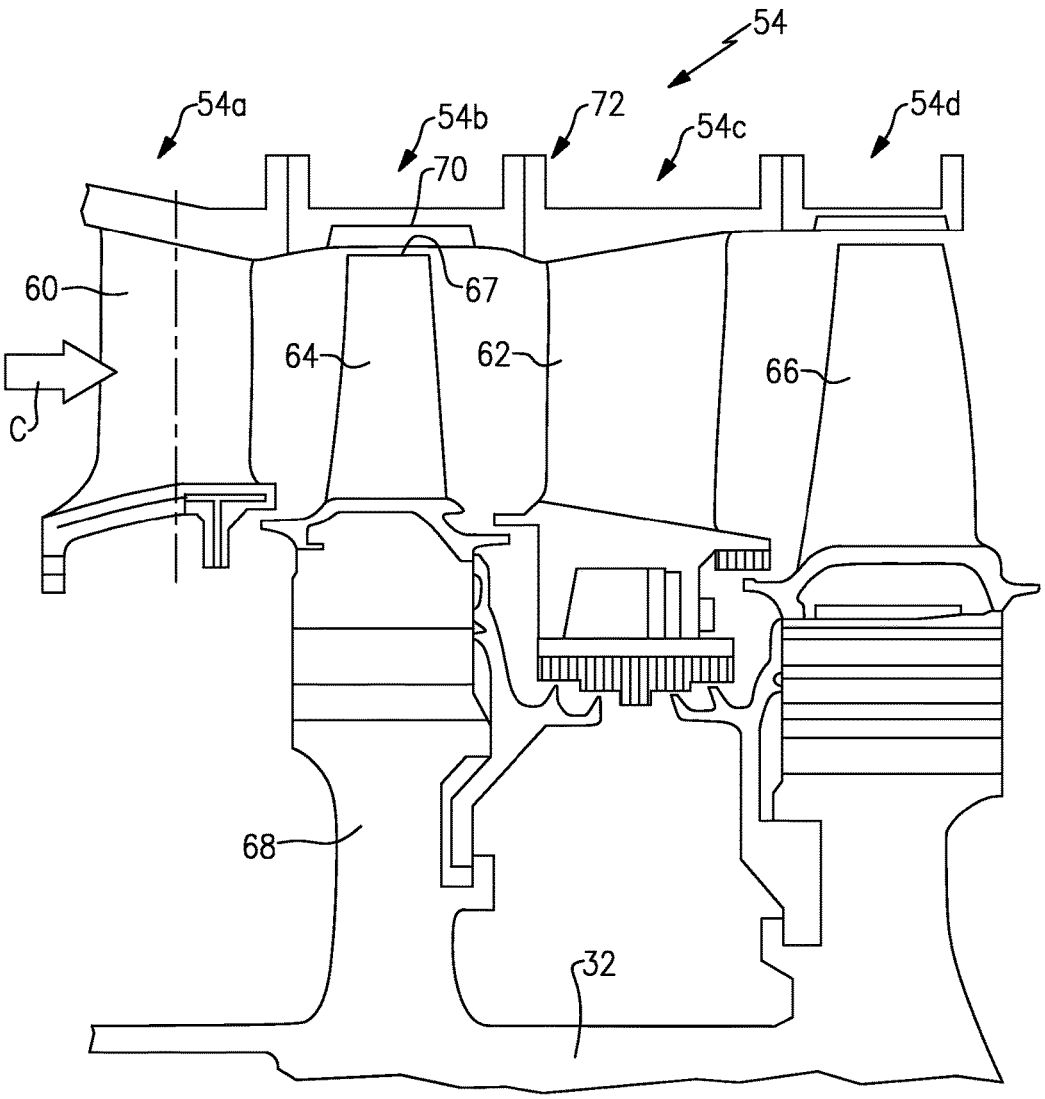
FIG. 2 is a cross-sectional view through a high pressure turbine section.

Referring to FIG. 2, a cross-sectional view through a high pressure turbine section 54 is illustrated. The disclosed gap seal may also be used in a compressor section, if desired. In the example high pressure turbine section 54, first and second arrays 54*a*, 54*c* of circumferentially spaced fixed vanes 60, 62 are axially spaced apart from one another. A first stage array 54*b* of circumferentially spaced turbine blades 64, mounted to a rotor disk 68, is arranged axially between the first and second fixed vane arrays 54*a*, 54*c*. A second stage array 54*d* of circumferentially spaced turbine blades 66 is arranged aft of the second array 54*c* of fixed vanes 62.

The turbine blades each include a tip 67 adjacent to a blade outer air seal 70 of a case structure 72. The first and second stage arrays 54*a*, 54*c* of turbine vanes and first and second stage arrays 54*b*, 54*d* of turbine blades are arranged within a core flow path C and are operatively connected to a spool 32.

Figure 3:
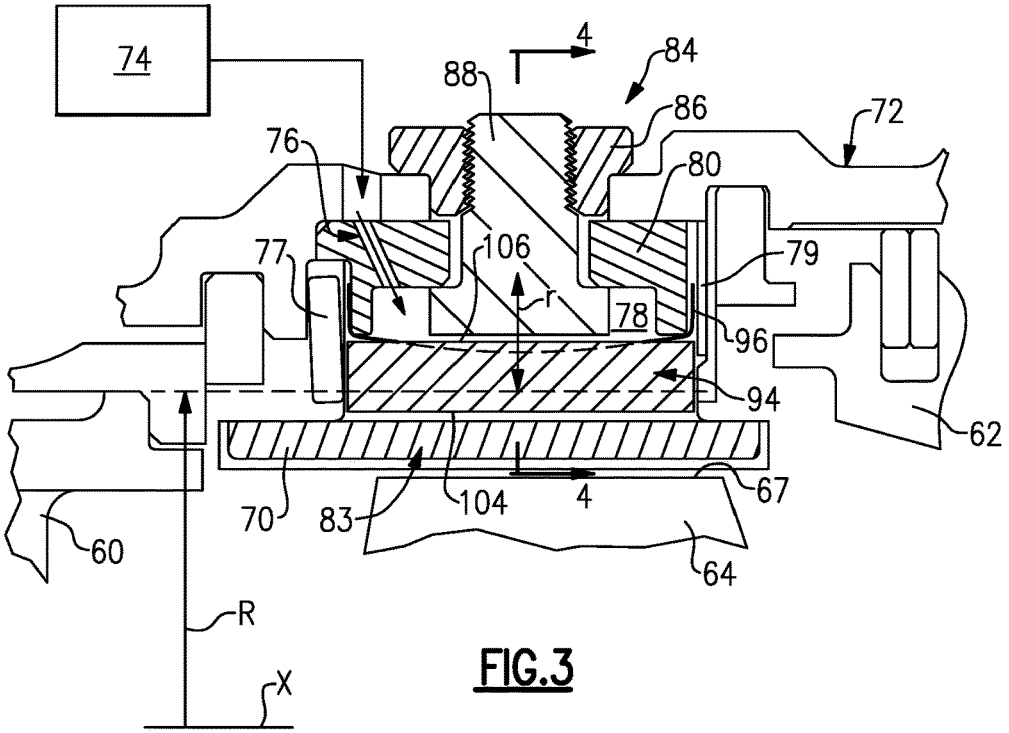
FIG. 3 is a cross-sectional view in an axial direction through one example blade outer air seal assembly, taken along line 3-3 of FIG. 4.
Figure 4:
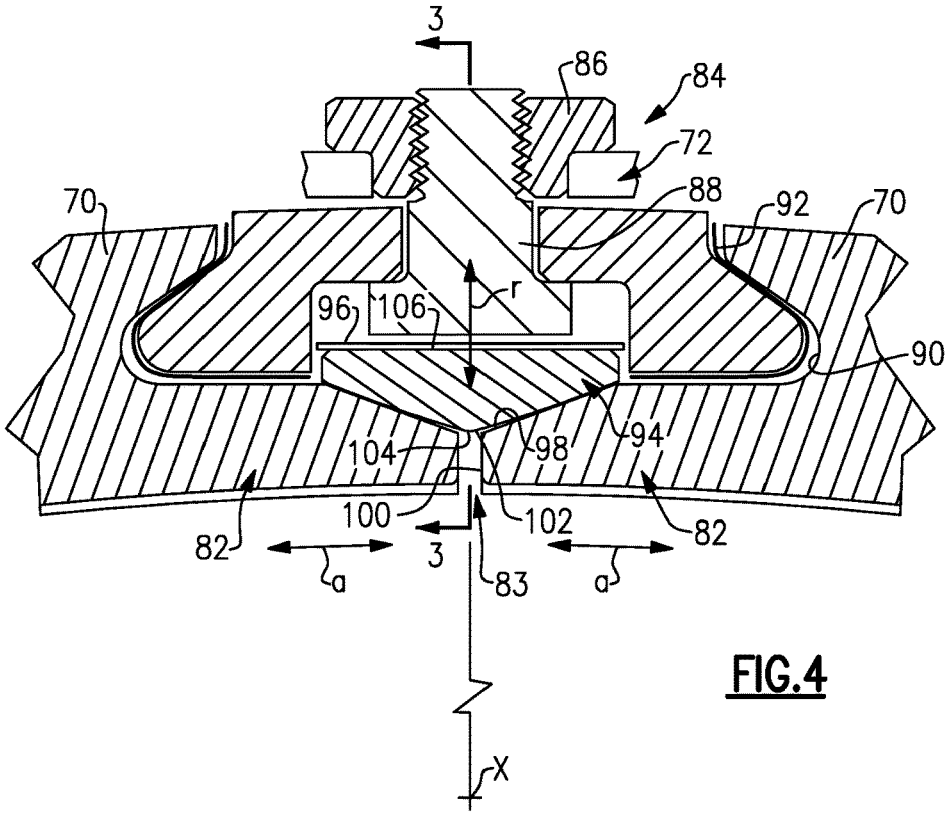
FIG. 4 is a cross-sectional view through the blade outer air seal assembly, taken along line 4-4 of FIG. 3.

Referring to FIGS. 3 and 4, a blade outer air seal assembly includes a circumferential array of blade outer air seal segments 70 that are supported relative to case structure 72, such as an outer case. The blade outer air seal 70 provides a seal relative to the tips 67 of the blade 64.

Typically, a fluid source 74 is in fluid communication with a backside of the blade outer air seal 70 to provide cooling of components in the area and to passages within the blade outer air seal 70. Passages 76 communicate fluid from the fluid source 74 to a cavity 78 on the backside of the blade outer air seal 70. In one example, the fluid source 74 is bleed air from the compressor section. Forward and aft seals 77, 79 provide a seal between the blade outer air seal 70 and the case structure 72 to contain the cooling fluid.

A mount block 80 secures adjacent ends 82 of the blade outer air seals 70 to the case structure 72 by a fastener assembly 84. In the example, the fastener assembly 84 includes a nut 86 and bolt 88. Each end 82 includes a groove 90 that receives a corresponding protrusion of the mount block 80. One or more shims 92 may be provided in the groove 90 between the end 82 and the mount block 80.

A circumferential gap 83 is provided between the ends 82 to permit expansion and contraction of the blade outer air seals 70 during engine operation. In the example, edges 100 of the adjacent ends 82 are generally parallel to one another and extend radially with respect to the axis X. A tapered surface 98 adjoins the edge and groove 90 at each end 82. The tapered surfaces 98 of the adjoining ends 82 form an obtuse angle with respect to one another.

Figure 5:
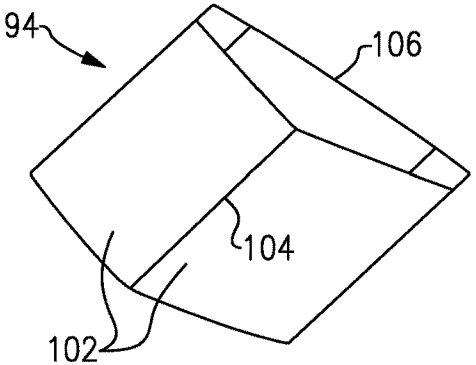
FIG. 5 is a perspective view of an example gap seal.
Figure 5A:
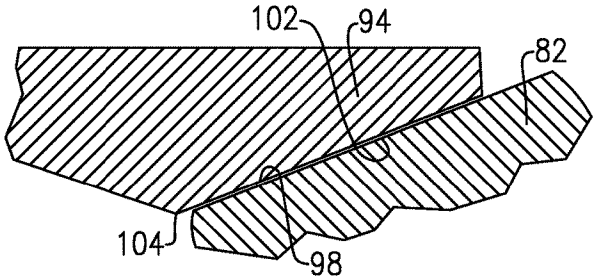
FIG. 5A is an enlarged view of the gap seal shown in FIG. 5 in engagement with the blade outer air seal.

A gap seal 94 (FIG. 5) engages the tapered surfaces 98 and obstructs the circumferential gap 83. In one example, the gap seal is wedge-shaped and includes sloped surfaces 102 that cooperate with the tapered surfaces 98. In this example, the tapered surfaces 98 and sloped surfaces 102 are in engagement with one another, as shown in FIGS. 4 and 5A. The sloped surfaces 102 adjoin one another at a first apex 104 that is aligned with the circumferential gap 83. The first apex 104 extends in a longitudinal direction of the body of the gap seal 94 and is arranged opposite a rectangular face 106. The sloped surfaces 98 and 102 are co-planar in the example.

Figure 6:
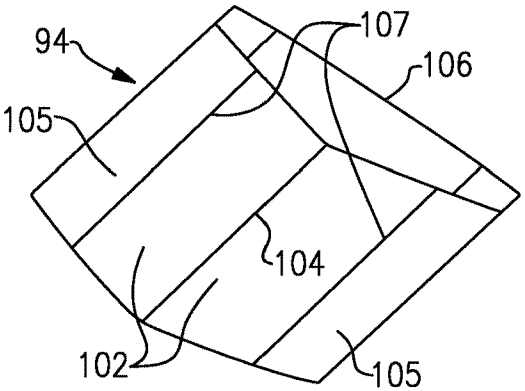
FIG. 6 is a perspective view of another example gap seal.

Referring to FIG. 6, the tapered surface of the gap seal 94 can include two separate, adjoining sloped surfaces, 102, 105, which meet at a second apex 107, providing a double wedge-shaped configuration. In the example, the sloped surfaces 102, 105 and second apex 107 are opposably symmetric (i.e., mirror images) about the axis of the first apex 104.

Figure 6A:
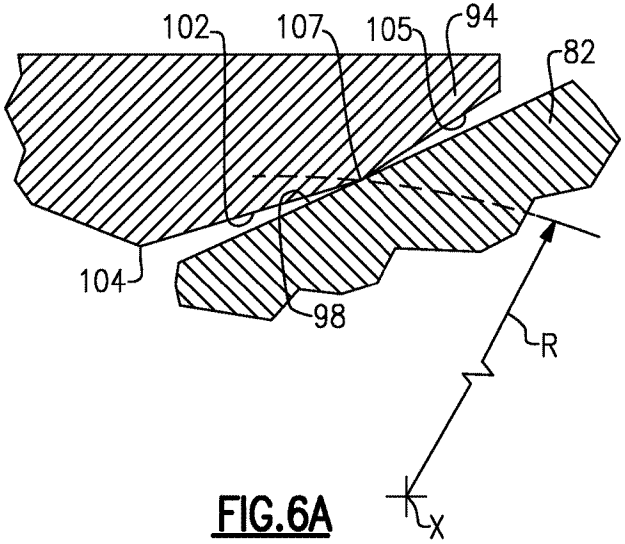
FIG. 6A is an enlarged view of the gap seal shown in FIG. 6 in engagement with the blade outer air seal.

The sloped surfaces 102, 105 of the gap seal 94 are not initially co-planer to the tapered surface 98. Contact between the gap seal 94 and the tapered surface 98 occurs between the second apex 107 and the tapered surface 98, as shown in FIG. 6A. This contact arrangement is typically referred to as "line contact". Generally the angular difference between the tapered surface 98 and sloped surfaces 102 and 104 are between 1 degree and 5 degrees, and preferably between 2 degrees and 4 degrees.

A biasing member 96 is arranged radially between the fastening assembly 84 and the gap seal 94. The biasing member 96 is configured to urge the gap seal 94 radially inward toward the tapered surfaces 98. In the example the biasing member 96 is a separate leaf spring, but alternatives to create a substantially radial biasing force would include wave springs, coil springs, and spring features integral to the mount block 80. In the example, the shims 92 are discrete from the biasing member 96.

The gap seal 94 and tapered surface 98 are urged into contact via the biasing member 96. In the first example, where the gap seal has a single sloped surface 102, relative movement of the blade outer air seal 82 will cause the tapered surface 98 to move, resulting in angular differences between the two surfaces such that the sloped surface 102 is no longer co-planer to tapered surface 98. In this first example, the sealing goes from intimate contact along the mating surfaces to a "line contact", depending upon the relative motion of the tapered surface 98 and the gap seal 94. In this first example, the consistency of the sealing interface of the gap seal can vary, and will be sensitive to operational variation of the surfaces and tolerances of the gap seal 94, mount block 67, and blade outer air seal 82.

In a second example, gap seal 94 includes two sloped surfaces 102 and 105 intersecting at apex 107. In this second example, the contact between the gap seal 94 and tapered surface 98 occurs as a "line contact" between the second apex 107 and the tapered surface 98. In this second example, when motion of the blade outer air seal 82 occurs, and the angular relationship between the tapered surface 98 and the gap seal 94 changes, the relative contact between the tapered surface 98 and the gap seal 94 remains a "line contact" between the second apex 107 and the tapered surface 98. In this second example, the consistency of the sealing interface is not dependent on surfaces remaining co-planer. In the second example, the sealing interface is substantially insensitive to operational variation and tolerances of the gap seal 94, mount block 67, and blade outer air seal 82.

Figure 7:
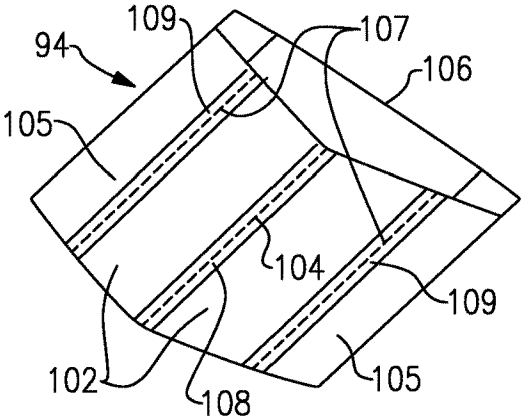
FIG. 7 is a perspective view of another example gap seal.
Figure 7A:
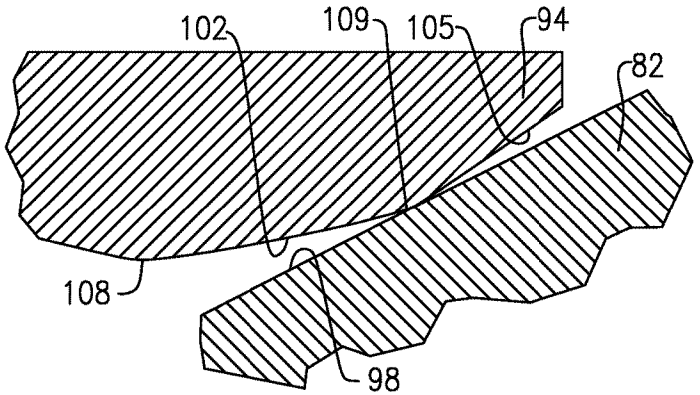
FIG. 7A is an enlarged view of the gap seal shown in FIG. 7 in engagement with the blade outer air seal.
Figure 7B:
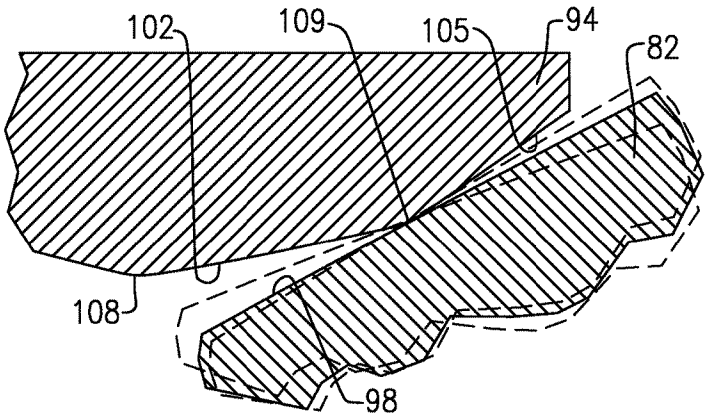
FIG. 7B depicts movement of the blade outer air seal in FIG. 7A in dashed lines.

Referring to FIG. 6, the first apex 104 and the second apex 107 may be a sharp edge formed by the intersection of the sloped surfaces 102 and 105. Referring to FIG. 7, alternatively, a first radius 108, may be introduced that smoothly transitions the sloped surfaces 102, and a second radius 109, may be introduced that smoothly transitions the sloped surfaces 102 and 105. The radius maybe chosen such that there is generally no sharp edge at the first apex 104 and second apex 107. In this example, the gap seal 94 contacts the tapered surface 98 on the second radius 109 in a generally "line contact" manner, without a sharp edge, resulting in a reduced potential for damage to the second apex 107, as shown in FIG. 7A. Articulation of the blade outer air seal 82 during engine operation is shown by the dashed lines in FIG. 7B.

The blade outer air seal segment 70 and the gap seal 94 have coefficient of thermal expansion that are generally between 2.5 ppm/° C. and 4.5 ppm/° C. The case structure 72 typically has a coefficient of thermal expansion that is generally between 9 ppm/° C. and 18 ppm/° C. In the example, each of the blade outer air seals 70 and the gap seal 94 are a ceramic-based material.

During engine operation, the blade outer air seal ends 82 expand and contract in a circumferential direction "a" increasing and decreasing the size of the circumferential gap 83. The biasing member 96 urges the gap seal 94 radially inward in a radially direction "r."

During operation the blade outer air seal 82, gap seal 94, forward seal 77, aft seal 79 and case structure 72 expand and contract axially. The blade outer air seal 82 and gap seal 94, are exposed to high flowpath temperatures associated with flow C and with cooling source 74. The resulting steady-state operating temperature of the blade outer air seal 82 and gap seal 94 material is typically between the higher temperature flow C and the cooler temperature associated with the cooling source 74. The forward and aft seals, 77, 79, mount block 80 and case structure 72 are primarily exposed to cooling source 74. The resulting steady-state operating temperature of the forward and aft seals, 77, 79, mount block 80 and case structure 72 are generally equal to the cooling source 74. Generally, blade outer air seal 82 and gap seal 94 operate at substantially higher temperature than the forward and aft seals, 77, 79, mount block 80 and case structure 72. However, due to the relatively low coefficient of thermal expansion of the blade outer air seal 82 and gap seal 94, the axial growth of the blade outer air seal 82 and gap seal 94 is substantially less than the forward and aft seals, 77, 79, mount block 80 and case structure.

The static pressure of the cooling source 74, within the first stage array 54*b* is desirably at the higher static pressure than the flow C at the first stage array 54*b*. Contact between the forward and aft seals 77, 79 and the blade outer air seal 82 and gap seal 94 is important to maintaining the pressure of cooling source 74. The use of a gap seal 94, made from the same material, and operating at similar temperature as the blade outer air seal 82, substantially reduced the variation in axial growth between the blade outer air seal 82 and the gap seal 94, thus the efficiency of the forward and aft seals 77 and 79 is greatly enhanced.

Referring to FIGS. 3 and 6A, contact between the forward seal and aft seal 77, 79 is desirable to occur at a radial location R defined by the "line contact" region established by the second apex 107 and the tapered surface 98. The combination of "line contact" along apex 107, and the circumferential contact at radius R results in the efficient compartmentalization of the cooling source 74, within the first blade array 54*b*, and the improved ability to maintain static pressure within the first blade array 54*a*, with the minimal magnitude of cooling flow through the passages 76.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine comprising:

a rotating stage of blades;

a circumferential array of blade outer air seal segments arranged radially outward of the blades, adjacent blade outer air seal segments provide a circumferential gap, facing ends of the adjacent blade outer air seal segments include tapered surfaces;

a gap seal engages the tapered surfaces and obstructs the circumferential gap, wherein the gap seal has a wedge-shaped cross-section in a circumferential direction that includes sloped surfaces;

a biasing member configured to urge the sloped surfaces radially inward toward the tapered surfaces;

an outer case, the blade outer air seal segments supported relative to the outer case;

a mount block; and wherein each of the facing ends includes a groove adjoining its respective tapered surface, and the mount block cooperates with the grooves to support the adjacent blade outer air seal segments to the outer case.

2. The gas turbine engine according to claim 1, comprising a turbine section, the rotating stage of blades arranged in the turbine section, and the blades are turbine blades.

3. The gas turbine engine according to claim 1, comprising a fastener assembly that secures the mount block to the outer case.

4. The gas turbine engine according to claim 3, wherein the biasing member is arranged radially between the fastening assembly and the gap seal, and the tapered surfaces form an obtuse angle with one another.

5. The gas turbine engine according to claim 4, comprising a shim arranged in the groove between and engaging the end and the mount block.

6. The gas turbine engine according to claim 5, wherein the shim is discrete from the biasing member.

7. The gas turbine engine according to claim 4, wherein a radial biasing member acts on the gap seal to adjust the gap seal's orientation to maintain contact with the tapered surfaces.

8. The gas turbine engine according to claim 1, comprising a mount block that is integral to the outer case.

9. The gas turbine engine according to claim 1, wherein the sloped surfaces join one another at an apex that extends in an axial direction, the apex arranged at the gap, wherein the apex is provided on a radially inner side of the gap seal.

10. The gas turbine engine according to claim 9, wherein each end includes an edge that extends in a radial direction, the edges adjoining the respective tapered surface, facing edges generally parallel to one another.

11. The gas turbine engine according to claim 1, wherein the blade outer air seal segments and the gap seal have coefficients of thermal expansion that are generally between 2.5 ppm/C and 4.5 ppm/C.

12. The gas turbine engine according to claim 11, wherein the blade outer air seal segments are a ceramic-based material.

13. The gas turbine engine according to claim 12, wherein the gap seal is a ceramic-based material.

14. A gas turbine engine comprising:

a rotating stage of blades;

a circumferential array of blade outer air seal segments arranged radially outward of the blades, adjacent blade outer air seal segments provide a circumferential gap, facing ends of the adjacent blade outer air seal segments include tapered surfaces;

a gap seal engages the tapered surfaces and obstructs the circumferential gap, wherein the gap seal has a wedge-shaped cross-section in a circumferential direction that includes sloped surfaces;

a biasing member configured to urge the sloped surfaces radially inward toward the tapered surfaces; and wherein the gap seal has a double wedge-shaped cross-section in a circumferential direction.

15. A gas turbine engine comprising:

a rotating stage of blades;

a circumferential array of blade outer air seal segments arranged radially outward of the blades, adjacent blade outer air seal segments provide a circumferential gap, facing ends of the adjacent blade outer air seal segments include tapered surfaces;

a gap seal engages the tapered surfaces and obstructs the circumferential gap, wherein the gap seal has a wedge-shaped cross-section in a circumferential direction that includes sloped surfaces;

a biasing member configured to urge the sloped surfaces radially inward toward the tapered surfaces;

wherein the sloped surfaces join one another at an apex that extends in an axial direction, the apex arranged at the gap, wherein the apex is provided on a radially inner side of the gap seal; and wherein the apex provides a line contact region at a radius from an engine axis, and comprising forward and aft seals provided between the outer case and the gap seal, the forward and aft seals engaging the gap seal at the line contact region and the radius.

16. A gap seal for a gas turbine engine blade outer air seal array, the gap seal comprising:

a body having sloped surfaces that join at an apex arranged opposite a rectangular face, the body is a ceramic-based material, wherein a radially inner side of the body has a double wedge-shaped cross-section in a circumferential direction.

17. The gap seal according to claim 16, wherein the apex extends in an axial direction of the body.

18. The gap seal according to claim 16, wherein the sloped surfaces are at an obtuse angle relative to one another.

19. The gap seal according to claim 16, wherein the sloped surfaces are planar.

* * * * *